US006488180B1

(12) United States Patent
Bayat

(10) Patent No.: US 6,488,180 B1
(45) Date of Patent: Dec. 3, 2002

(54) POWER OPERATED CAULKING GUN

(76) Inventor: John Jahangir Bayat, 3501 Cashill Blvd., Reno, NV (US) 89509

( * ) Notice: Subject to any disclaimer, the term of this patent is extended or adjusted under 35 U.S.C. 154(b) by 0 days.

(21) Appl. No.: 09/825,251

(22) Filed: Apr. 2, 2001

(51) Int. Cl.[7] ..... B67D 5/52

(52) U.S. Cl. ..... 222/137; 222/333; 222/390; 74/424.78

(58) Field of Search ..... 222/137, 326, 222/333, 390; 74/424.78

(56) References Cited

U.S. PATENT DOCUMENTS

| | | | | |
|---|---|---|---|---|
| 3,208,638 | A | | 9/1965 | Frenzel et al. |
| 3,635,378 | A | | 1/1972 | DeHart |
| 3,854,629 | A | | 12/1974 | Blieberger |
| 4,114,781 | A | | 9/1978 | Doyel |
| 4,180,187 | A | | 12/1979 | Ben-Haim |
| 4,234,104 | A | | 11/1980 | Apuzzo et al. |
| 4,306,671 | A | | 12/1981 | Fisher |
| 4,322,022 | A | | 3/1982 | Bergman |
| 4,335,834 | A | | 6/1982 | Zepkin |
| 4,986,454 | A | | 1/1991 | Riley |
| 5,027,984 | A | | 7/1991 | Gakhar |
| 5,058,781 | A | | 10/1991 | Aronie et al. |
| 5,207,357 | A | * | 5/1993 | Aronie et al. ..... 222/137 |
| 5,341,958 | A | | 8/1994 | Bayat et al. |

FOREIGN PATENT DOCUMENTS

| | | |
|---|---|---|
| JP | 3-99231 | 4/1991 |

* cited by examiner

*Primary Examiner*—Philippe Derakshani
(74) *Attorney, Agent, or Firm*—Edward S. Wright

(57) ABSTRACT

Power operated caulking gun having a housing, a cradle extending from the housing for receiving a cartridge of fluent material, a push rod for engagement with a cartridge in the cradle for dispensing the fluent material from the cartridge, a drive shaft extending from the housing and adapted to be received in the chuck of a drive tool, drive means interconnecting the drive shaft and the push rod, and a stabilizer extending from the housing for engagement with an abutment on the barrel of the drive tool to prevent rotation of the caulking gun relative to the drive tool. In some embodiments, the cradle is adapted to hold a cartridge having two tubes of fluent material positioned side-by-side, and the caulking gun includes a second push rod for dispensing material from the second tube in the cartridge.

11 Claims, 6 Drawing Sheets

POWER OPERATED CAULKING GUN

This invention pertains generally to the application of fluent materials such as sealants and adhesives and, more particularly, to a power operated caulking gun for applying caulk and other fluent materials packaged in tubular cartridges.

U.S. Pat. No. 5,341,958 and the references cited therein disclose a number of power operated caulking guns for dispensing fluent materials such as sealants and adhesives from tubular cartridges. Such materials are widely used in construction, and the power operated caulkers allow them to be applied much faster and more easily than conventional, manually operated caulking guns.

The power operated caulking guns heretofore provided have had certain limitations and disadvantages such as a relatively complex and expensive drive mechanism which is an integral part of the gun. With pneumatically operated caulking guns, the need for an internal drive motor is eliminated, but compressors are required.

Another problem with the power caulkers heretofore provided is that they can dispense a fluent material from only one tube at a time. Consequently, they are not suitable for use with materials such as epoxies which require the use of a second component such as a hardener.

It is in general an object of the invention to provide a new and improved caulking gun.

Another object of the invention is to provide a caulking gun of the above character which can be used with an existing driving tool such as a cordless electric drill.

Another object of the invention is to provide a caulking gun of the above character which is readily attached to and detached from the driving tool.

Another object of the invention is to provide a caulking gun of the above character which can is suitable for use with materials such as epoxies which have different components in separate tubes.

These and other objects are achieved in accordance with the invention by providing a power operated caulking gun having a housing, a cradle extending from the housing for receiving a cartridge of fluent material, a push rod for engagement with a cartridge in the cradle for dispensing the fluent material from the cartridge, a drive shaft extending from the housing and adapted to be received in the chuck of a drive tool, drive means interconnecting the drive shaft and the push rod, and a stabilizer extending from the housing for engagement with an abutment on the barrel of the drive tool to prevent rotation of the caulking gun relative to the drive tool. In some embodiments, the cradle is adapted to hold a cartridge having two tubes of fluent material positioned side-by-side, and the caulking gun includes a second push rod for dispensing material from the second tube in the cartridge.

Figure 1:
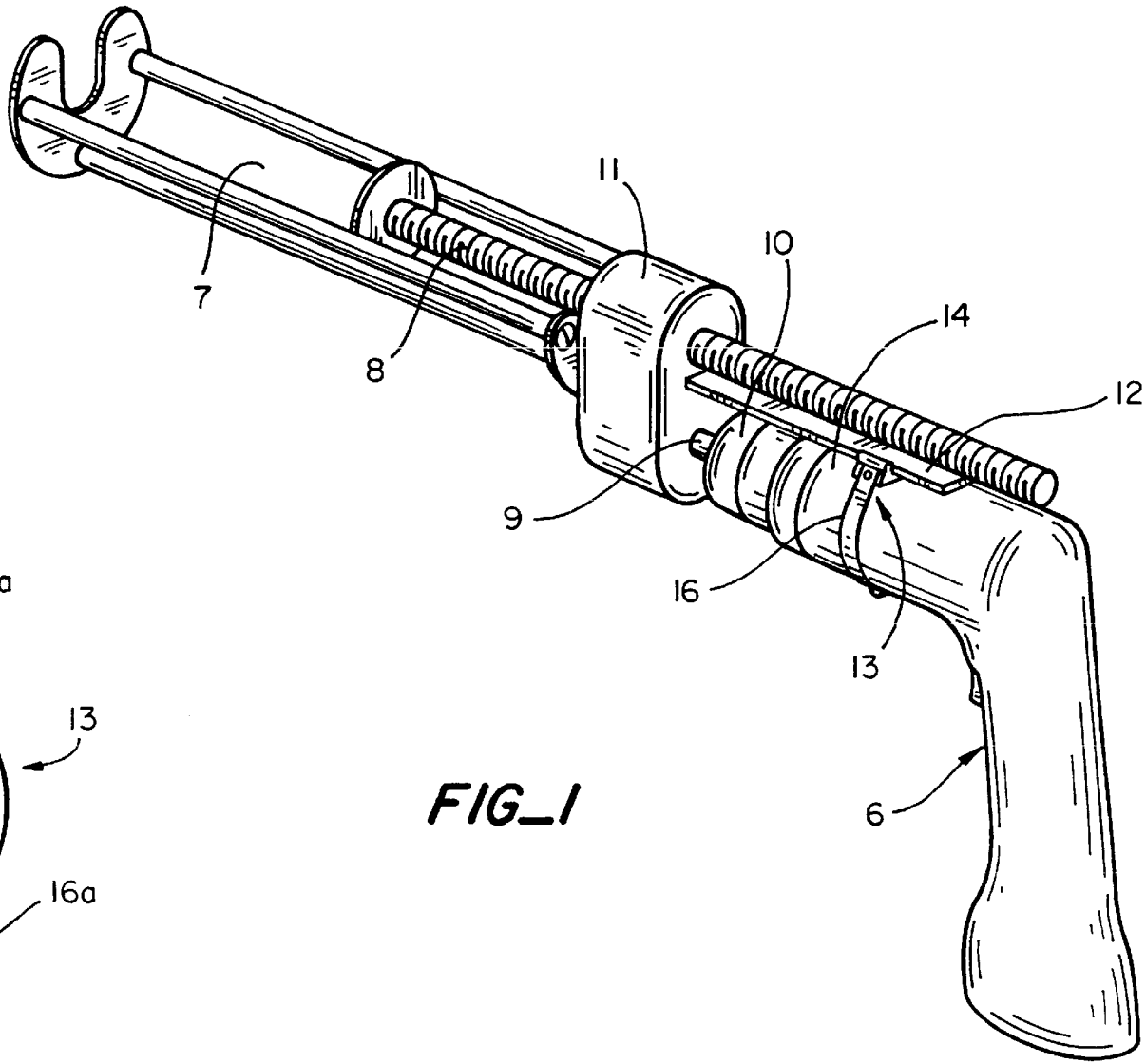
FIG. 1 is an isometric view of one embodiment of a power operated caulking gun incorporating the invention.
Figure 2:
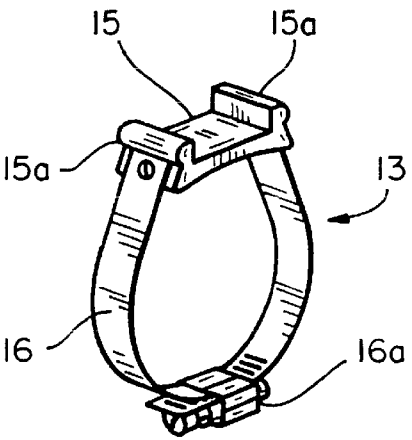
FIG. 2 is an isometric view of a stabilizer bracket in the embodiment of FIG. 1.

In FIG. 1 the invention is illustrated 1 in connection with a cordless electric drill 6. In this embodiment, the caulking gun includes a cradle 7 for receiving a cartridge of fluent material, a threaded push rod 8 for dispensing the material from the cartridge, a drive shaft 9 which is received in the chuck 10 of the drill, and a gear box 11 which interconnects the drive shaft and the push rod for advancing the push rod upon rotation of the drive shaft. A stabilizing bar 12 extends rearwardly from the gear box and is received in a bracket 13 which is mounted on the housing or barrel 14 of the drill.

Bracket 13 includes a saddle 15 in which the stabilizing bar is received, and a mounting band 16 which is tightened around the barrel of the drill to clamp the bracket firmly in place. The band is similar to the band used in hose clamps, and it includes a worm screw 16*a* for tightening and loosening it. The stabilizing bar is received loosely in the saddle in that it is not affixed to the saddle, although it is seated firmly between a pair of raised shoulders 15*a* on opposite sides of the saddle. The only actual connection between the caulking gun and the drill is the one between the drive shaft and the chuck. Thus, the caulking gun is readily attached to and removed from the drill simply by tightening and loosening the chuck.

Even though the stabilizing bar is not connected to the bracket, it is nevertheless held firmly in place by the saddle. The shoulders between which the bar is seated function as limiting abutments that prevent the bar from moving laterally. With the bar constrained in this manner, the body of the caulking gun is locked in position on the drill and cannot rotate when the drive shaft is turned.

The bracket can be left on the barrel of the drill when the caulking gun is removed. Since it is relatively small and unobtrusive, the bracket will not interfere with the use of the drill for other purposes.

Figure 3:
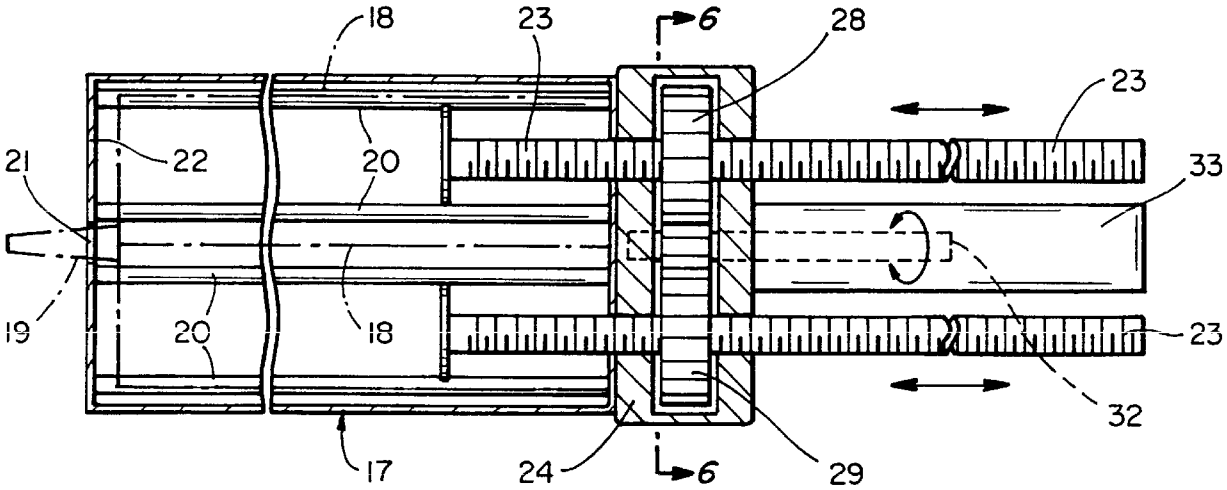
FIG. 3 is horizontal sectional view of another embodiment of a dual power operated caulking gun incorporating the invention.
Figure 4:
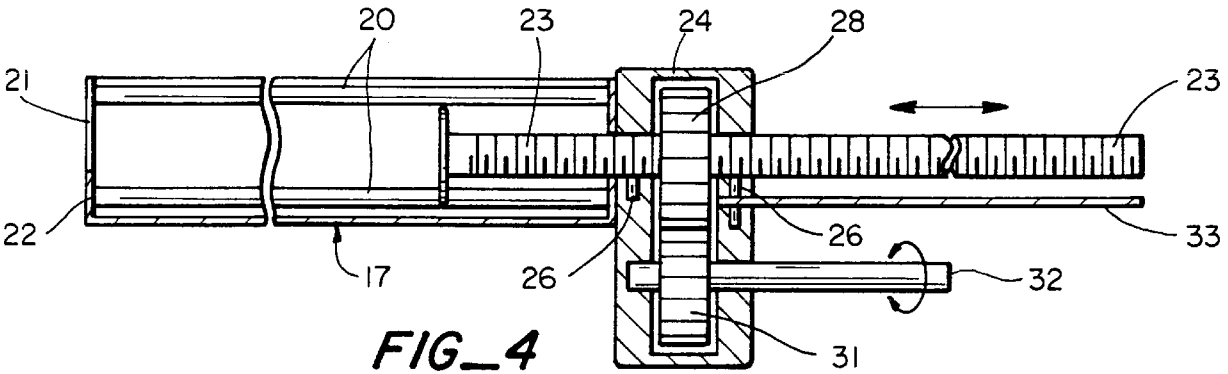
FIG. 4 is a vertical sectional view of the embodiment of FIG. 3.
Figure 5:
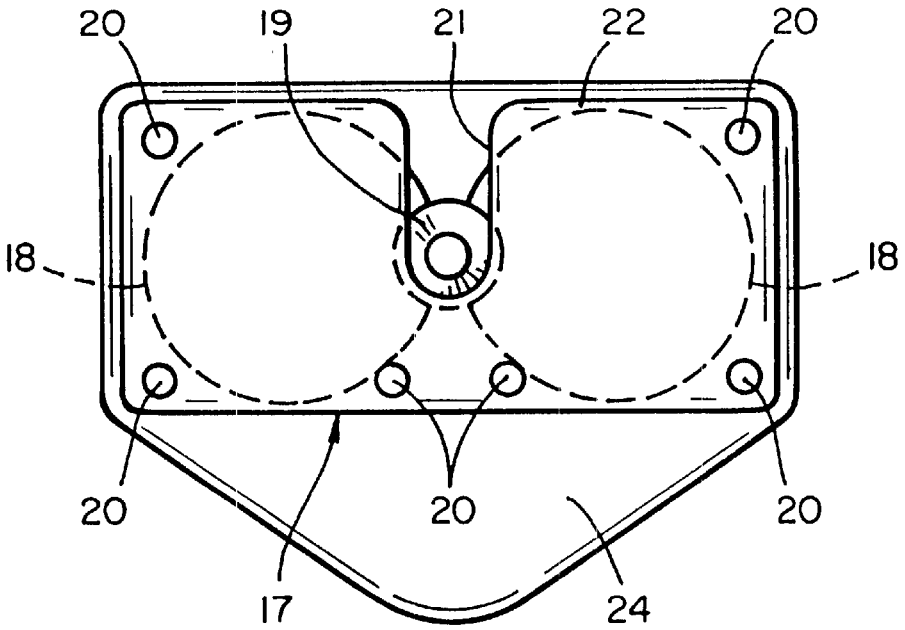
FIG. 5 is a front elevational view of the embodiment of FIG. 3.
Figure 6:
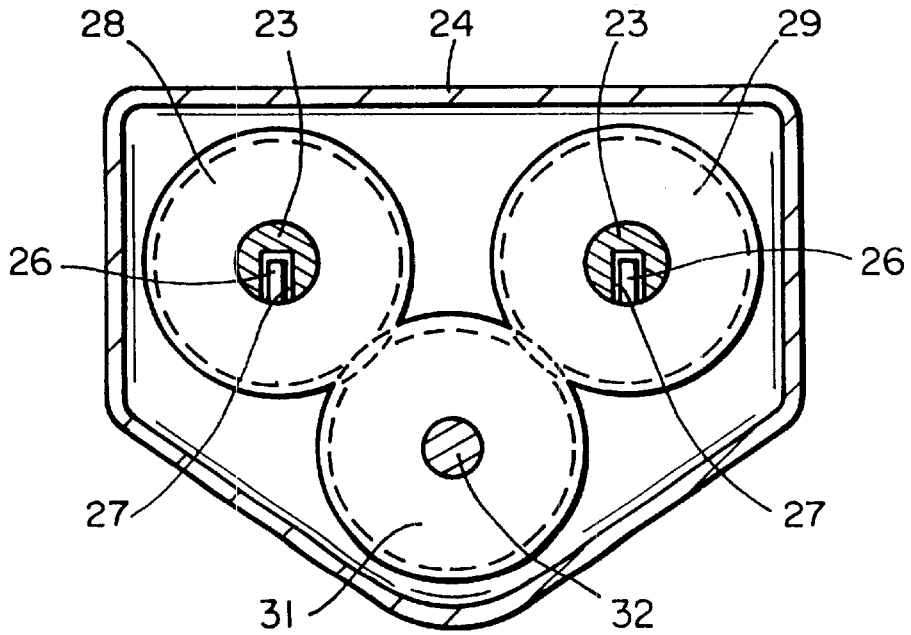
FIG. 6 is a cross-sectional view taken along line 6—6 in FIG. 3.

In the embodiment of FIG. 3, the caulking gun has a cradle 17 for receiving a cartridge having a pair of tubes 18, 18 positioned side-by-side with a nozzle 19 through which fluent materials in the two tubes are dispensed. Cartridges of this type generally contain materials such as epoxies having two components which are kept separate until use, with mixing occurring as they pass through the nozzle. Support rods 20 extend longitudinally of the cradle, and nozzle 19 is received in a notch 21 in the front wall 22 of the cradle.

A pair of push rods 23, 23 extend longitudinally of the cradle for dispensing the material from the two tubes. The push rods pass through a gear housing 24 to the rear of the cradles and are constrained against rotation by pins 26 which are received in longitudinally extending slots 27 in the rods. The push rods are externally threaded and are driven by internally threaded gears 28, 29 within the housing. Those gears are driven by a drive gear 31 affixed to a drive shaft 32 which is adapted to be received in the chuck of a cordless drill or otherwise connected to a drive tool (not shown). A stabilizing bar 33 extends rearwardly from the housing as in the embodiment of FIG. 1.

In operation and use, the caulking gun is mounted on the drive tool, with drive shaft 32 being gripped by the chuck and stabilizing bar 33 being received in the saddle 15 of a bracket 13 mounted on the barrel of the tool. The cartridge is placed in the cradle, with the nozzle 19 extending through notch 21. Upon rotation of the drive shaft, drive gear 31 rotates the internally threaded gears 28, 29 on the push rods, causing the push rods to advance or retract, depending upon the direction in which the drive shaft is turned. As the push rods advance, they drive the pistons within the tubes, thereby expelling the fluent material through the nozzle at the forward end of the cartridge.

Figure 7:
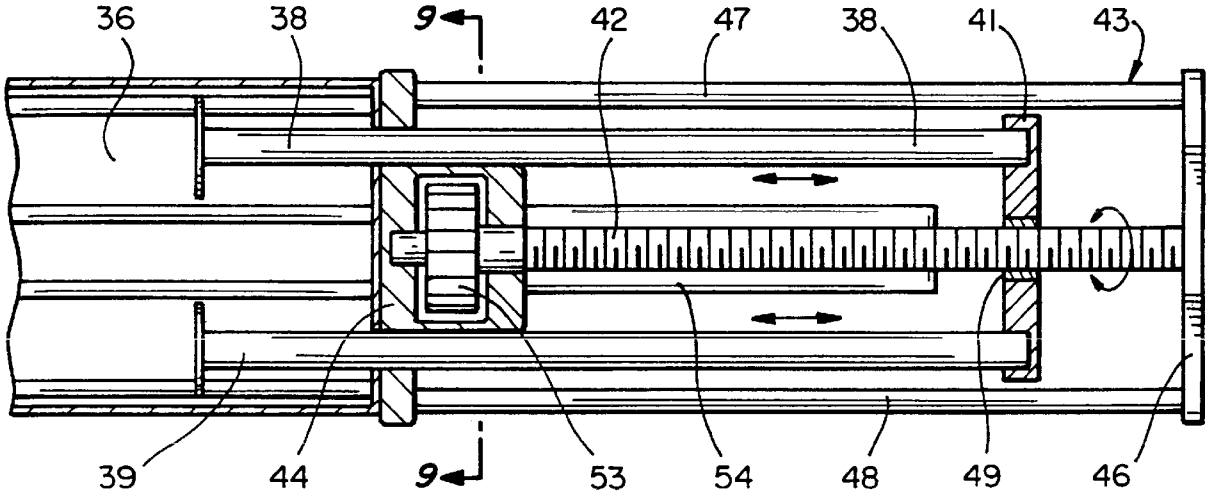
FIG. 7 is a fragmentary horizontal sectional view of another embodiment of a dual power operated caulking gun incorporating the invention.
Figure 8:
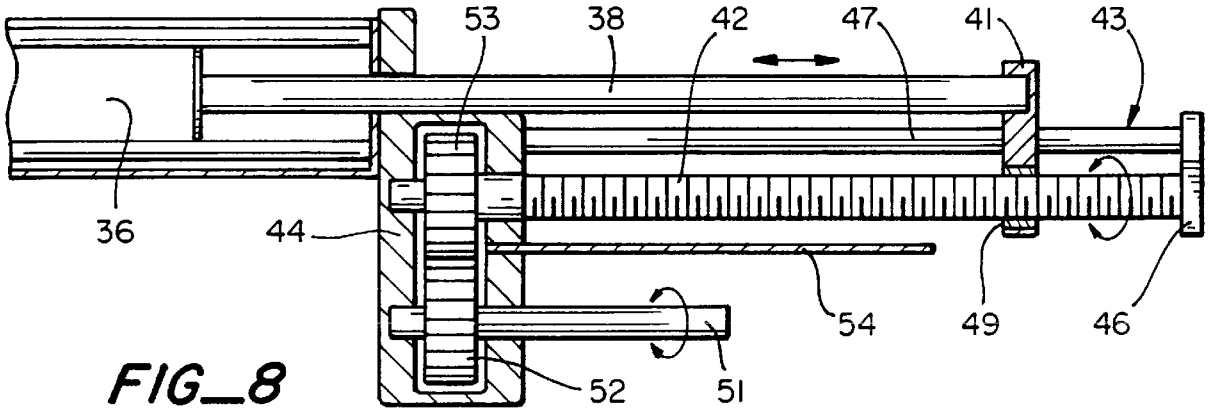
FIG. 8 is a fragmentary vertical sectional view of the embodiment of FIG. 7.
Figure 9:
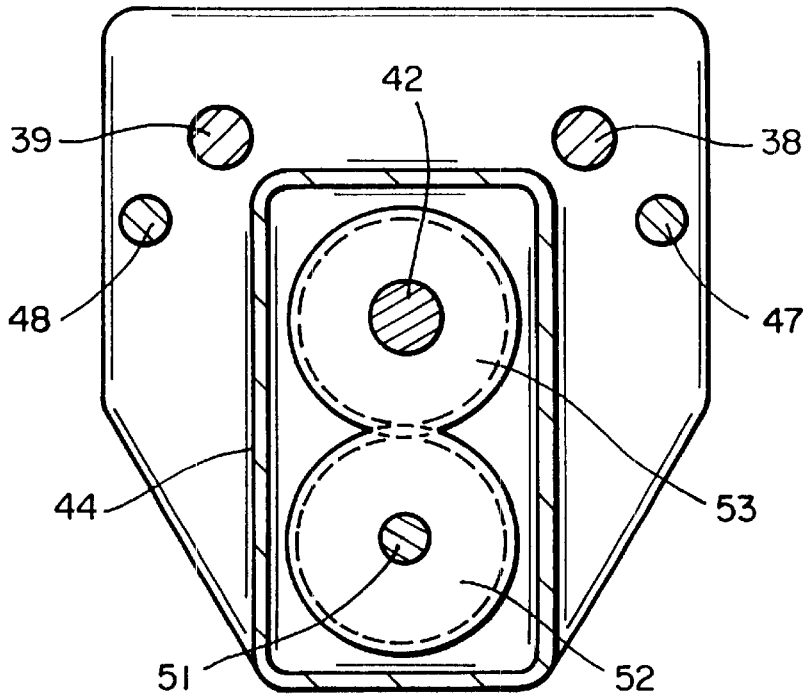
FIG. 9 is a cross-sectional view taken along line 9—9 in FIG. 7.
Figure 12:
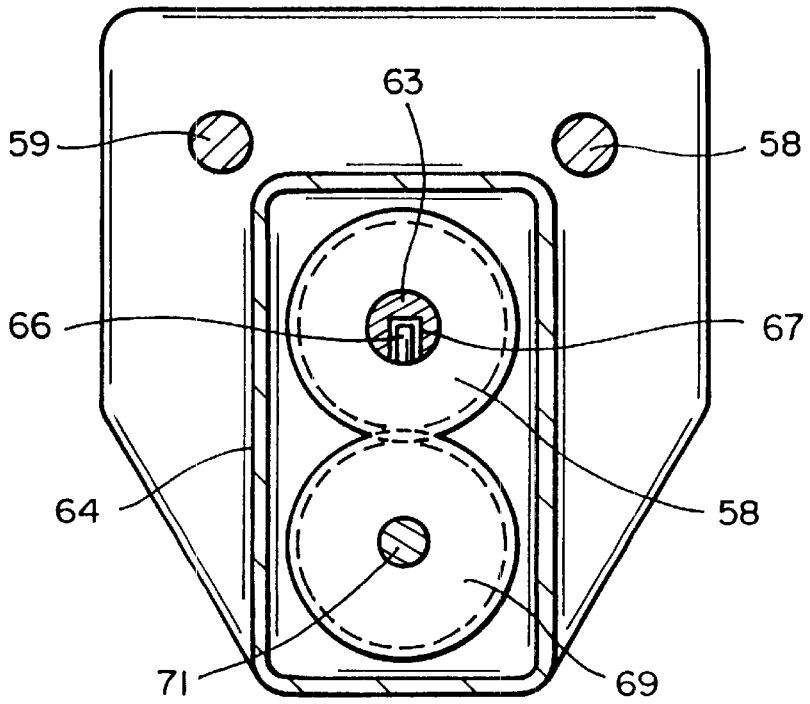
FIG. 12 is a cross-sectional view taken along line 12—12 in FIG. 10.

In the embodiment of FIG. 7, the caulking gun has a cradle 36 similar to cradle 17, with push rods 38, 39 extending longitudinally of the cradle for dispensing fluent material from the tubes of a cartridge placed therein. In this embodiment, the push rods are affixed to a carriage 41 which is driven by a lead screw 42. The lead screw is rotatively mounted in a frame 43 consisting of a gear housing 44 at the rear of the cradles, an end plate 46 which is spaced to the rear of the housing, and a pair of rails 47, 48 which extend between the housing and the end plate.

The lead screw is threadedly received in a nut 49 on carriage 41, and is rotated by a drive shaft 51, a drive gear 52 affixed to the drive shaft and a driven gear 53 affixed to the lead screw. A stabilizing bar 54 extends rearwardly from the gear housing as in the embodiment of FIG. 1.

In use, the drive shaft is mounted in the chuck of a cordless drill or other driving tool, and the stabilizing bar is received in the saddle of the bracket which is mounted on the body of the tool. Upon rotation of the drive shaft, gears 52, 53 turn the lead screw, advancing the carriage and the push rods.

Figure 10:
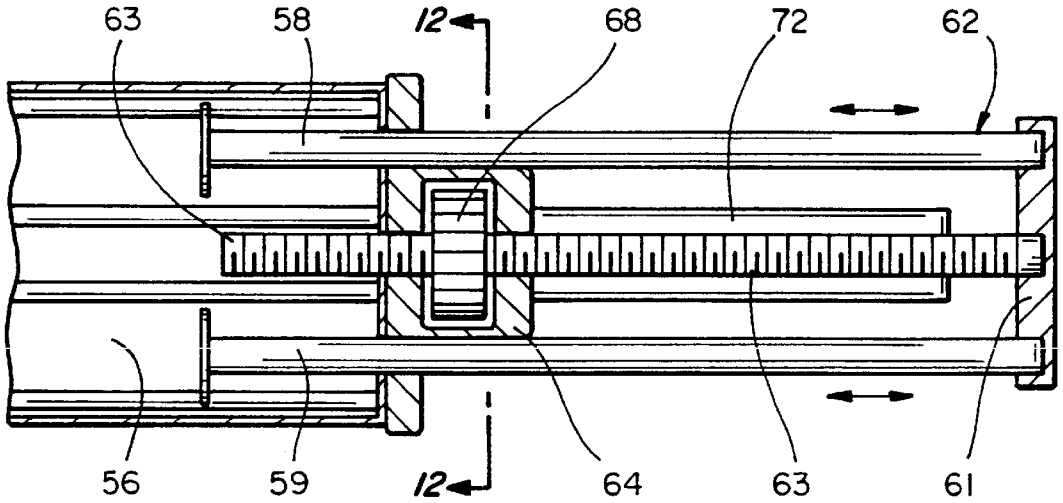
FIG. 10 is fragmentary horizontal sectional view of another embodiment of a dual power operated caulking gun incorporating the invention.
Figure 11:
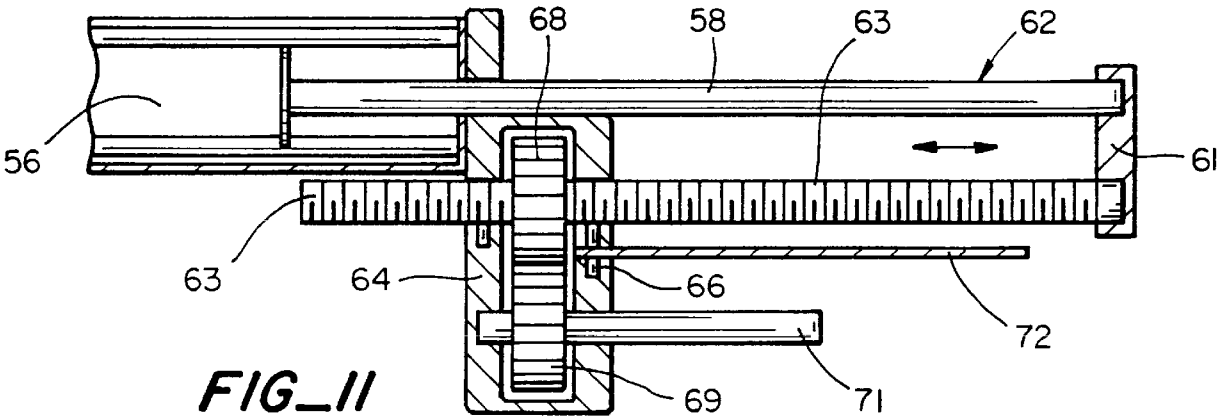
FIG. 11 is a fragmentary vertical sectional view of the embodiment of FIG. 10.

In the embodiment of FIG. 10, the caulking gun once again has a cradle 56 similar to cradle 17, with push rods 58, 59 extending longitudinally of the cradle for dispensing fluent material from the tubes of a cartridge placed therein. In this embodiment, the push rods are affixed to the end plate 61 of a carriage 62.

The carriage is driven by a lead screw 63 which is affixed to end plate 61. The lead screw passes through a gear housing 64 at the rear of the cradles and is constrained against rotation by pins 66 which are affixed to the housing and received in a longitudinally extending slot 67 in the lead screw. The lead screw is driven by an internally threaded gear 68 which is driven by a drive gear 69 affixed to a drive shaft 71. A stabilizing bar 72 extends rearwardly from the gear housing for engagement with an abutment on the body of the drive tool.

Upon rotation of the drive shaft, drive gear 69 rotates the internally threaded gear 68 on lead screw 63, causing the lead screw, the carriage and the push rods to advance or retract.

If desired, cradle 17 and/or cradles 36, 56 can be replaced with a pair of individual trays or cradles for holding individual tubes of caulking material, in which case the gun can be used for dispensing the material from the two tubes simultaneously.

The invention has a number of important features and advantages. It can be used with almost any existing electric drill and can be quickly and easily installed and removed since the only connection between the caulking gun and the drill is the drive shaft in the drill chuck. The stabilizing bar slides into and out of its seat in the saddle, and holds the gun in a steady position on the drive tool. Unlike power operated caulking guns of the prior art, it can be used with cartridges containing materials such as epoxies which have two components that are dispensed from different tubes.

It is apparent from the foregoing that a new and improved caulking gun has been provided. While only certain presently preferred embodiments have been described in detail, as will be apparent to those familiar with the art, certain changes and modifications can be made without departing from the scope of the invention as defined by the following claims.

What is claimed is:

1. A power operated caulking gun comprising: a drive tool having a chuck rotatively mounted on a barrel, a saddle mounted on the barrel of the drive tool, a cradle for holding a cartridge of fluent material, a push rod engagable with a cartridge in the cradle for dispensing the fluent material from the cartridge, a drive shaft clamped in the chuck of the drive tool, drive means interconnecting the drive shaft and the push rod, and a stabilizing bar connected to the cradle and received loosely in the saddle for preventing rotation of the cradle on the drive tool.

2. The caulking gun of claim 1 wherein the drive tool is a cordless electric drill.

3. A power operated caulking gun comprising: a drive tool having a chuck rotatively mounted on a barrel, a saddle mounted on the barrel of the drive tool by a band clamped about the barrel, a cradle for holding a cartridge of fluent material, a push rod engagable with a cartridge in the cradle for dispensing the fluent material from the cartridge, a drive shaft clamped in the chuck of the drive tool, drive means interconnecting the drive shaft and the push rod, and a stabilizing bar connected to the cradle and received loosely in the saddle for preventing rotation of the cradle on the drive tool.

4. A power operated caulking gun comprising: a drive tool having a chuck rotatively mounted on a barrel, a saddle mounted on the barrel of the drive tool, a cradle adapted to hold a cartridge having two tubes of fluent material positioned side-by-side, first and second push rods for dispensing the fluent material from the cartridge, a drive shaft clamped in the chuck of the drive tool, drive means interconnecting the drive shaft and the push rods, and a stabilizing bar connected to the cradle and received loosely in the saddle for preventing rotation of the cradle on the drive tool.

5. The caulking gun of claim 4 wherein the cradle extends from one side of the housing, and the stabilizer comprises a bar which extends from an opposite side of the housing.

6. A power operated caulking gun, comprising: a drive tool having a chuck rotatively mounted on a barrel, a housing, a cradle extending from the housing for receiving a cartridge of fluent material, a push rod for engagement with a cartridge in the cradle for dispensing the fluent material from the cartridge, a drive shaft extending from the housing and clamped in the chuck of the drive tool, drive means interconnecting the drive shaft and the push rod, and a stabilizer extending from the housing in abutting engagement with an abutment on the barrel of the drive tool to prevent rotation of the caulking gun relative to the drive tool, with no other connection between the caulking gun and the drive tool.

7. A power operated caulking gun comprising: a longitudinally extending cradle for holding a cartridge containing two tubes of fluent material, a pair of externally threaded push rods engagable with a cartridge in the cradle for dispensing the fluent material from the tubes, means for preventing rotation of the push rods, a drive shaft adapted to be received in the chuck of a drive tool, a drive gear driven by the drive shaft, and a pair of internally threaded driven gears driven by the drive gear in threaded engagement with the push rods so that rotation of the drive shaft causes the push rods to travel longitudinally of the cradle.

8. A power operated caulking gun comprising: a longitudinally extending cradle for holding a cartridge of fluent material, an elongated threaded rod which is constrained against rotation but free to travel longitudinally of the cradle, a drive shaft adapted to be received in the chuck of a drive tool, a drive gear affixed to the drive shaft, and an internally threaded driven gear driven by the drive gear in threaded engagement with the rod for advancing the rod relative to the cradle.

9. The caulking gun of claim 8 wherein the rod is adapted to engage a cartridge in the cradle for dispensing fluent material from the cartridge.

10. A power operated caulking gun comprising: a longitudinally extending cradle for holding a cartridge containing two tubes of fluent material, a drive shaft adapted to be rotated by a drive tool, a pair of externally threaded push rods movable longitudinally of the cradle for dispensing the fluent material from the tubes, means constraining the push rods against rotation, a drive gear affixed to the drive shaft, and a pair of internally threaded driven gears which engage the external threads on the push rods and are driven by the drive gear.

11. A power operated caulking gun comprising: a longitudinally extending cradle for holding a cartridge containing two tubes of fluent material, a drive shaft adapted to be rotated by a drive tool, a pair of push rods mounted to a carriage for movement longitudinally of the cradle to dispense the fluent material from the cartridge, a lead screw affixed to the carriage, a drive gear affixed to the drive shaft, and an internally threaded driven gear which threadedly engages the lead screw and is driven by the drive gear so that rotation of the gears causes the lead screw to travel axially, thereby moving the carriage and the push rods longitudinally of the cradles.

* * * * *